US006908340B1

(12) United States Patent
Shafer

(10) Patent No.: US 6,908,340 B1
(45) Date of Patent: Jun. 21, 2005

(54) METHOD AND SYSTEM FOR REDUCING CROSSTALK IN A BACKPLANE

(75) Inventor: Matthew S. Shafer, Ankeny, IA (US)

(73) Assignee: Xilinx, Inc., San Jose, CA (US)

( * ) Notice: Subject to any disclaimer, the term of this patent is extended or adjusted under 35 U.S.C. 154(b) by 0 days.

(21) Appl. No.: 10/659,972

(22) Filed: Sep. 11, 2003

(51) Int. Cl.[7] ..... H01R 13/648
(52) U.S. Cl. ..... 439/608
(58) Field of Search ..... 439/608, 941, 439/76, 70, 108, 701, 79; 174/255, 250, 261, 174/262; 361/794, 795, 731, 792; 710/300, 710/2

(56) References Cited

U.S. PATENT DOCUMENTS

| | | | | |
|---|---|---|---|---|
| 5,397,861 | A | 3/1995 | Urquhart, II | |
| 6,384,341 | B1 * | 5/2002 | Rothermel et al. | 174/255 |
| 6,527,587 | B1 * | 3/2003 | Ortega et al. | 439/608 |

OTHER PUBLICATIONS

Gautam Patel, Kevin Ryan; "Designing 3.125 Gbps Backplane Systems"; presented in Munich Germany at Electronica Conference on Nov. 13, 2002; pp. 1-29.

Matt Shafer, Bodhi Das, Gautam Patel; "Connector and Chip Vendors Unite to Produce a High-Performance 10 Gb/s NRZ-Capable Serial Backplane"; presented on Jan. 27-30 in Santa Clara, California; DesignCon 2003 High-Performance System Design Conference; 19 pages.

Teradyne Connection Systems; "GbX Drawings"; downloaded from http://www.teradyne.com/prods/tcs/products/connectors/backplane/gbx/drawings.html; Jul. 27, 2003; 7 pages.

Teradyne Connection Systems; GbX Configuration; downloaded from http://www.teradyne.com/prods/tcs/products/connectors/backplane/gbx/modconfig.html; Jul. 27, 2003; 1 page.

* cited by examiner

*Primary Examiner*—Alexander Gilman
(74) *Attorney, Agent, or Firm*—Kim Kanzaki

(57) ABSTRACT

A method and system for configuring the transmit and receive elements or structures in connector such that crosstalk can be reduced. The connector connects serdes modules in first PCB to serdes modules in one or more second PCBs via a backplane. The connector includes: first and second transmit connection positions in a first direction; first and second receive connection positions; and a ground shield positioned in the first direction between the first and second transmit connection positions and the first and second receive connection positions, wherein the first and second transmit connection positions do not have an interposing ground shield in another direction.

15 Claims, 7 Drawing Sheets

| Name | Valu | Comment |
|---|---|---|
| Materials | Rogers 4350<br>FR4<br>Nelco 4000 | |
| Dimensions | Length = 23.5"<br>Width = 12"<br>Thickness ~ 250mil | |
| Connector | GbX | |
| Troughs | Star Configuration<br>Mesh Configuration<br>Test Structures | 3 Total |
| Link length | 3, 6, 9, 12, 15, 18<br>4.5, 7.5, 10.5, 13.5, 16.5, 19.5 | Switch Card1, Mesh<br>Switch Card2 |
| Connector size | 25 column<br>10 column | |
| Connector space | Populated: 3"<br>Footprints: 1.5" | 1.5" between switch card connectors |
| Total # of layers | 22 (8 signal, 10 ground, 2 power) | Microstrip (top/bottom) |
| Routing layers | 3, 5, 7, 9, 14, 16, 18, 20 | |
| Vias | Backdrilled to 5 for signals on 3 & 5<br>Backdrilled to 9 for signals on 7 & 9<br>Backdrilled to 16 for signals on 14 & 16<br>PTH for signals on 18 & 20 | |
| Antipad clearance | | Elliptical |
| Trace width | 8mil | Differential stripline |
| Spacing | 8mil | |
| Dielectric thickness | Rogers: 10mil<br>FR4:<br>Nelco: | Assume 1/2oz copper |

FIG. 6

| Layer # (from top) | Value |
|---|---|
| 1 | Top |
| 2 | Ground |
| 3 | Signal |
| 4 | Ground |
| 5 | Signal |
| 6 | Ground |
| 7 | Signal |
| 8 | Ground |
| 9 | Signal |
| 10 | Ground |
| 11 | Power |
| 12 | Power |
| 13 | Ground |
| 14 | Signal |
| 15 | Ground |
| 16 | Signal |
| 17 | Ground |
| 18 | Signal |
| 19 | Ground |
| 20 | Signal |
| 21 | Ground |
| 22 | Bottom |

FIG. 7

METHOD AND SYSTEM FOR REDUCING CROSSTALK IN A BACKPLANE

FIELD OF THE INVENTION

The present invention relates generally to backplanes and more specifically, transmitter and receiver connection arrangements in a high-speed serial backplane.

BACKGROUND

Serial backplanes have become popular for providing high-speed connections between printed circuit boards (PCBs). Typically, serial backplanes employ a serializer at a transmitting end to convert and transmit data in serial order, and a deserializer at a receiving end to convert the data back to parallel form once received. Such serializer/deserializer ("serdes") modules have become the benchmark for asynchronous communication and have provided clear advantages over parallel busses.

FIG. 1 is a diagram of two PCBs 110 and 112 connected together via a high-speed serial backplane 114. Printed circuit board 110 includes a central processing unit (CPU) 120 connected to a random access memory (RAM) 122 and logic 124. PCB board 110 also includes a serdes 126 connected to logic 124. The CPU 120, RAM 122, logic 124, and serdes 126 may be part of a programmable logic device (PLD), for example, a field programmable gate array (FPGA) such as Virtex II Pro™ from Xilinx Corp. of San Jose, Calif., which is attached to board 110. Printed circuit board 112 includes circuitry similar to board 110 (and also may be part of a second FPGA), such as serdes 140 connected to logic 142, which in turn is connected to CPU 144 and RAM 146. Serdes 126 is connected to serdes 140 via high-speed serial backplane 114. Serdes 126 transmits serial data over signal line 132 to the receiver at serdes 140. Serdes 140 transmits serial data over signal line 136 to the receiver at serdes 126. Connection points 130, 133, 134, and 137 indicate were a connector may be used to connect the PCBs e.g., boards 110 and 112, to backplane 114.

The PCBs (normally called daughtercards), e.g., PCBs 110 and 112, are affixed to circuit board connectors, which allow the PCBs to be electrically connected to the backplane 114. Typically a series of circuit board connectors are spaced regularly along the length of the backplane. Multiple circuit layers of the backplane route the transmit and receive signals and power to the connectors and hence connect the PCBs to each other. Plated through holes electrically interconnect runs of different circuit layers as needed.

FIG. 2 is a simplified side view of an example of a daughter card connector 210 and its associated backplane connector 220 of the prior art. This simplified view represents the GbX™ 4-Pair daughtercard signal module, i.e., a daughtercard connector, and backplane signal module, i.e., a backplane connector, of Teradyne Inc. of Boston, MA. A daughtercard 212 may be, for example, board 110 or board 112 of FIG. 1. The daughtercard 212 is affixed to daughtercard connector 210. Daughtercard connector 210 is plugged into backplane connector 220. Backplane connector 220 has the pins, e.g., pins 230, 231, 232, 233, 234, 235, 236, and 237. Daughtercard connector 210 has an area 214, which has the corresponding female structures to receive the pins.

Backplane connector 220 is affixed to backplane 222 (which is similar to backplane 114 of FIG. 1). Backplane connector 220 includes an array of pins (e.g., 8×25). FIG. 2 shows a sideview subset of eight pins, e.g., 230–237, and three ground shields 240, 242 and 244 interposed between each pair of pins, e.g., pin pairs 230/231, 232/233, 234/235, and 236/237, respectively. The pin pairs, e.g., 230 and 231, may receive/transmit a differential signal, where, for example, pin 230 may be the positive(P) part and pin 231 may be the negative(N) part of the differential signal. For purposes of illustration, the pins 230–237 are part of a "column", e.g., column 310, in a connector pin assignment array as shown in FIG. 3. Each ground shield, e.g., 240, 242 or 244, is made up of a metal plate and is connected to ground to provide shielding between the pin pairs.

FIG. 3 shows a prior art connector pin assignment 300 for multiple serdes modules on a daughter card. The connector positions TXP 320 and TXN 322 indicate that the positive transmit signal (TXP) of a first serdes and the negative transmit signal (TXN) of the first serdes is assigned to pins 230 and 231 in a first column 310 and first row 350. The connector positions RXP 324 and RXN 326 indicate that the positive receive signal (RXP) of the first serdes and the negative receive signal (RXN) of the first serdes is assigned to pins in row 350 and column 312 (not shown in FIG. 1). Similarly, the connector positions TXP 330 and TXN 332 indicate that the positive transmit signal (TXP) of a second serdes and the negative transmit signal (TXN) of the second serdes is assigned to row 350 and column 314 (not shown in FIG. 1). The connector positions RXP 334 and RXN 336 indicate that the positive receive signal (RXP) of the second serdes and the negative receive signal (RXN) of the second serdes is assigned to row 350 and column 316 (not shown in FIG. 1). In addition, the connector positions TXP 340 and TXN 342 indicate that the positive transmit signal (TXP) of a third serdes and the negative transmit signal (TXN) of the third serdes is assigned to pins 232 and 233 in column 310 and row 352. The connector positions RXP 344 and RXN 346 indicate that the positive receive signal (RXP) of the third serdes and the negative receive signal (RXN) of the third serdes is assigned to other pins in a second row 352 and column 312 (not shown in FIG. 1). Connector positions TXP 360 and TXN 362 are assigned to pin positions of 234 and 235 in FIG. 1. Connector positions TXP 364 and TXN 366 are assigned to pin positions of 236 and 237 in FIG. 1.

The connector pin assignment 300 of FIG. 3 forms an array with columns 310, 312, 314 and 316, and rows 350, 352, 354, and 356. In each element of the array, for example, column 310 and row 350, is a differential pair, e.g., TXP 320 and TXN 322, indicating a positive and negative portion of a differential signal. Ground shields, e.g. 240, 242, and 244, are interposed between each row, e.g., 350/352, 352/354, and 354/356, respectively. The side view in FIG. 2 of backplane 220 shows only the first column 310 and for the example of the GbX™ connector, there may be 25 columns of which only four columns are shown in FIG. 3.

As the speed of data transmission increases into the gigahertz range and beyond, near-end cross talk becomes a significant problem for connector pin assignments such as that of FIG. 3. As the transmit signal, is relatively much larger than the receive signal, the transmit signal couples with the receive signal. For example, the differential transmit signal from TXP 320 and TXN 322 couples into the signal received by RXP 324 and RXN 326 and also the signal received by RXP 334 and RXN 336. Since linear equalization circuits cannot typically distinguish a signal from the crosstalk, it is difficult to correct for the crosstalk using circuitry alone. In addition, the transmit circuits may have a transmit pre-emphasis which aggravates the crosstalk.

One prior technique used to reduce cross talk was to either completely shield the transmitters or the receivers. For example, in FIG. 3, TXP 320 and TXN 322 would have a ground shields on all four sides. Or, for example, RXP 334 and RXN 336 would have ground shields on all four sides. In effect there would not only be ground shields 240, 242, and 244 in the horizontal direction, but ground shields in the vertical direction (not shown) between columns 310/312, 312/314, 314/316, and so forth. In the case of the GbX™ 4-Pair backplane signal module, there may be 25 columns. This is a difficult and expensive solution and is typically impractical to implement.

Therefore, an improved connector pin assignment is needed to reduce the crosstalk in a high-speed serial backplane, where the ground shields are substantially in only one direction.

SUMMARY

The present invention relates generally to a method and system for configuring the transmit and receive elements or structures in connector such that crosstalk can be reduced. The connector connects serdes modules in first PCB to serdes modules in one or more second PCBs via a backplane.

An embodiment of the present invention includes a connector for connecting a circuit board to a backplane. The connector includes: first and second transmit connection positions in a first direction; first and second receive connection positions; and a ground shield positioned in the first direction between the first and second transmit connection positions and the first and second receive connection positions, wherein the first and second transmit connection positions do not have an interposing ground shield in another direction.

Another embodiment of the present invention includes a connector to a serial backplane. The connector includes: first receive connection elements on the connector for at least two serializer/deserializer modules, wherein two of the first receive connection elements do not have a first interposing ground plane; second transmit connection elements for the at least two serializer/deserializer modules, wherein the second transmit connection elements are separated from the first receive connection elements by a second interposing ground plane. The connector may further include: third transmit connection elements for other serializer/deserializer modules, the third transmit connection elements positioned adjacent to the second transmit connection elements, wherein the third transmit connection elements are separated from the second transmit connection elements by a third interposing ground plane; and fourth receive connection elements for the other serializer/deserializer modules, where the fourth receive connection elements are positioned adjacent to the third transmit connection elements, wherein the fourth receive connection elements are separated from the third transmit connection elements by a fourth interposing ground plane.

Yet another embodiment of the present invention has a method for connecting serializer/deserializer modules to a backplane. The method includes a step of selecting transmit/receive pairs from the serializer/deserializer modules, where each transmit/receive pair has an associated transmit connection structure and an associated receive connection structure in a connector; and a step of configuring a ground structure between the associated transmit connection structures and the associated receive connection structures, wherein there is no interposing ground structure between the associated receive connection structures or the associated transmit connection structures.

The present invention will be more full understood in view of the following description and drawings.

BRIEF DESCRIPTION OF THE DRAWINGS

FIG. 6 is a backplane specification of an aspect of the present invention;

FIG. 7 is a table of the layers of a backplane of an aspect of the present invention.

DETAILED DESCRIPTION

In the following description, numerous specific details are set forth to provide a more thorough description of the specific embodiments of the invention. It should be apparent, however, to one skilled in the art, that the invention may be practiced without all the specific details given below. In other instances, well known features have not been described in detail so as not to obscure the invention.

For serdes modules there is typically a transmit/receive pair of circuits, hence an associated pair of transmit/receive connection elements or structures. In one embodiment of the present invention, the transmit connection elements (or structures) and receive connection elements (or structures) may be pairs of pins indicated by differential pin assignments TXP/TXN and RXP/RXN, respectively. In another embodiment the transmit/receive connection elements or structures may be the corresponding female elements or structures to receive the pairs of pins. In other embodiments rather that differential signals, the signals may be single-ended, e.g., only one pin rather than a pair of pins, and while the following description of the preferred embodiment is for a differential signal, it should be understood that single-ended signals and a mixture of differential and single-ended signals are also included in the scope of the present invention.

Figure 1:
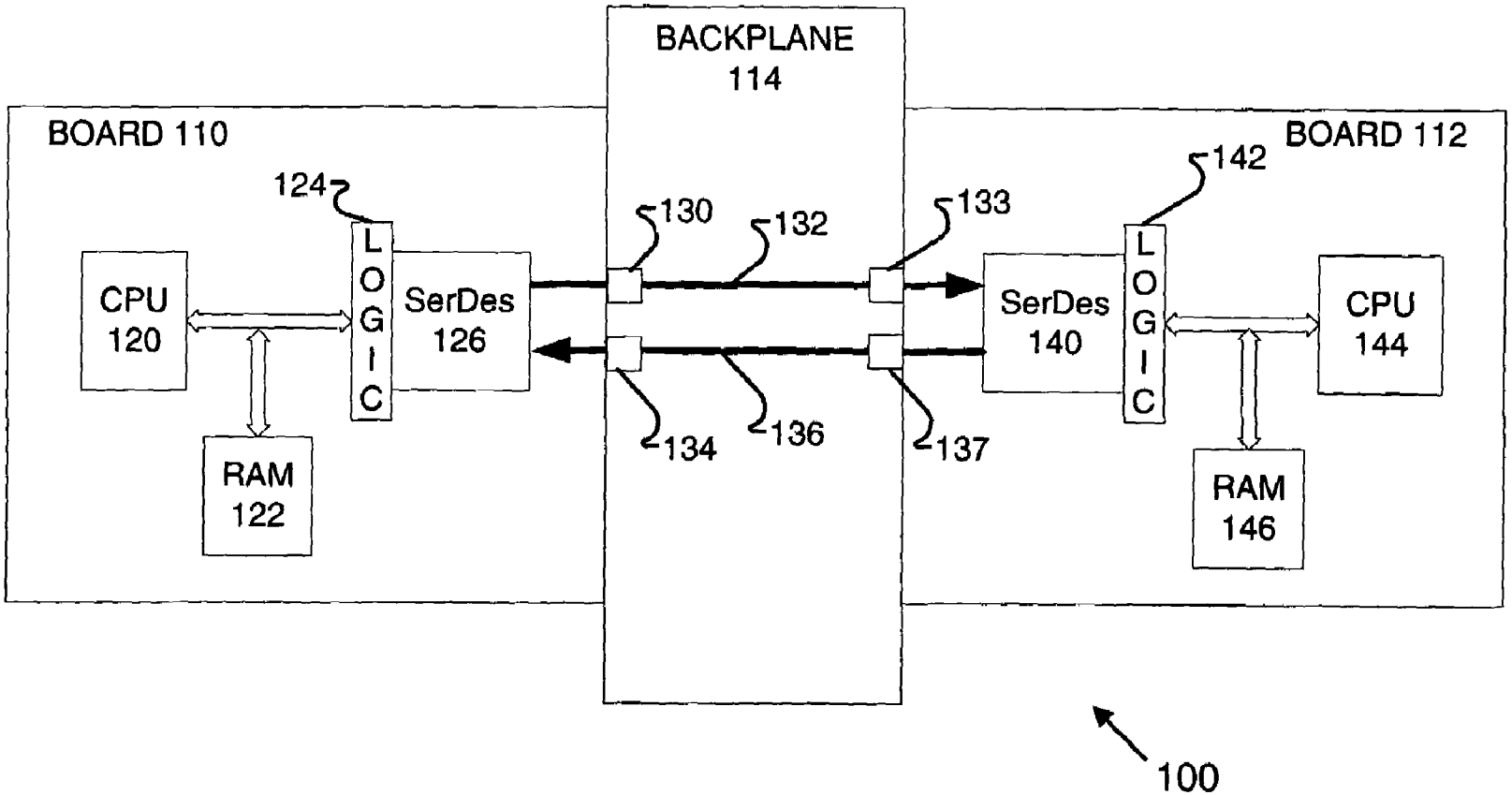
FIG. 1 (PRIOR ART)
FIG. 1 is a diagram of two PCBs connected together via a high speed serial backplane of the prior art.
Figure 2:
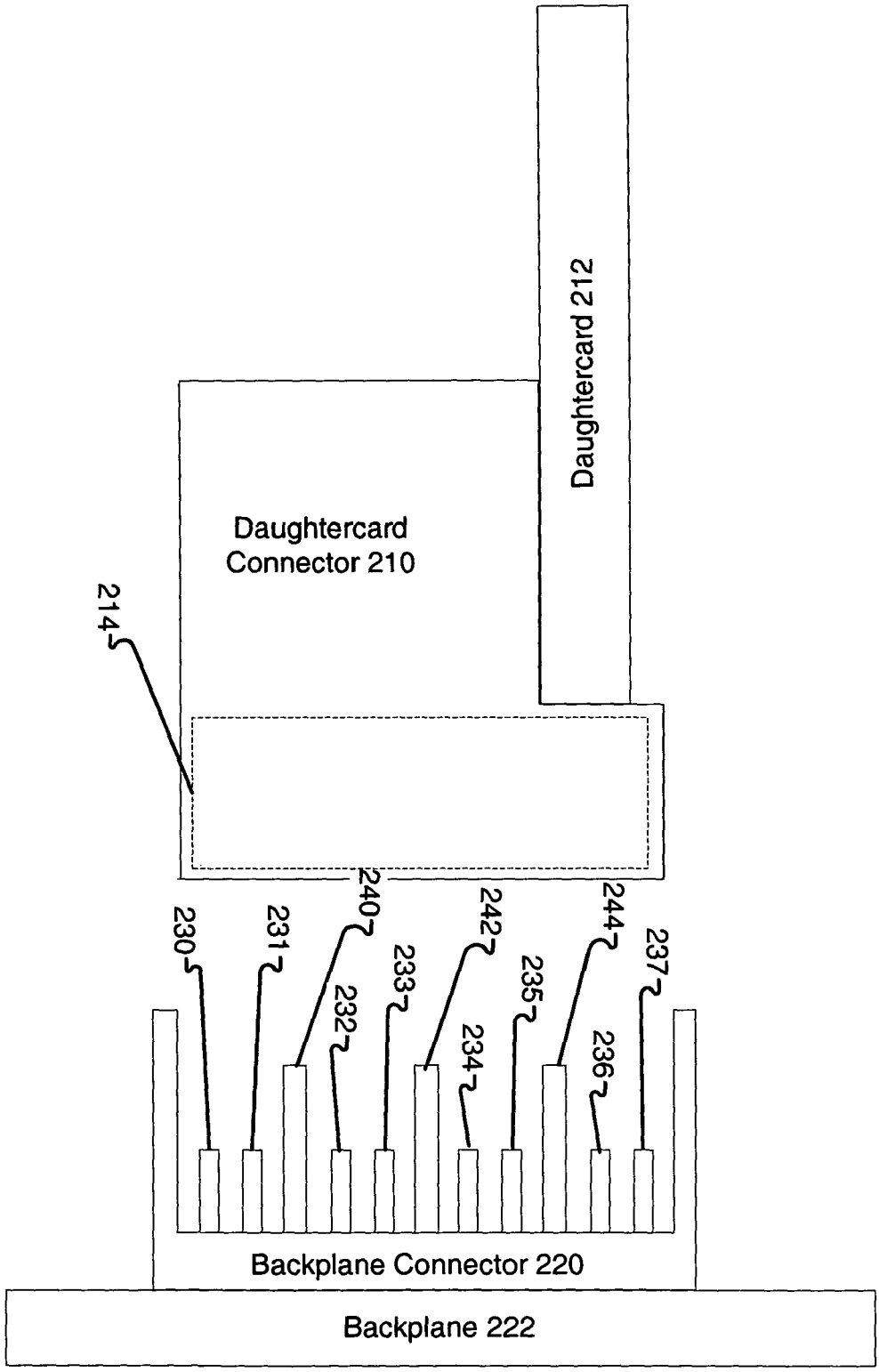
FIG. 2 (PRIOR ART)
FIG. 2 is a simplified side view of an example of a daughter card connector and its associated backplane connector of the prior art.
Figure 3:
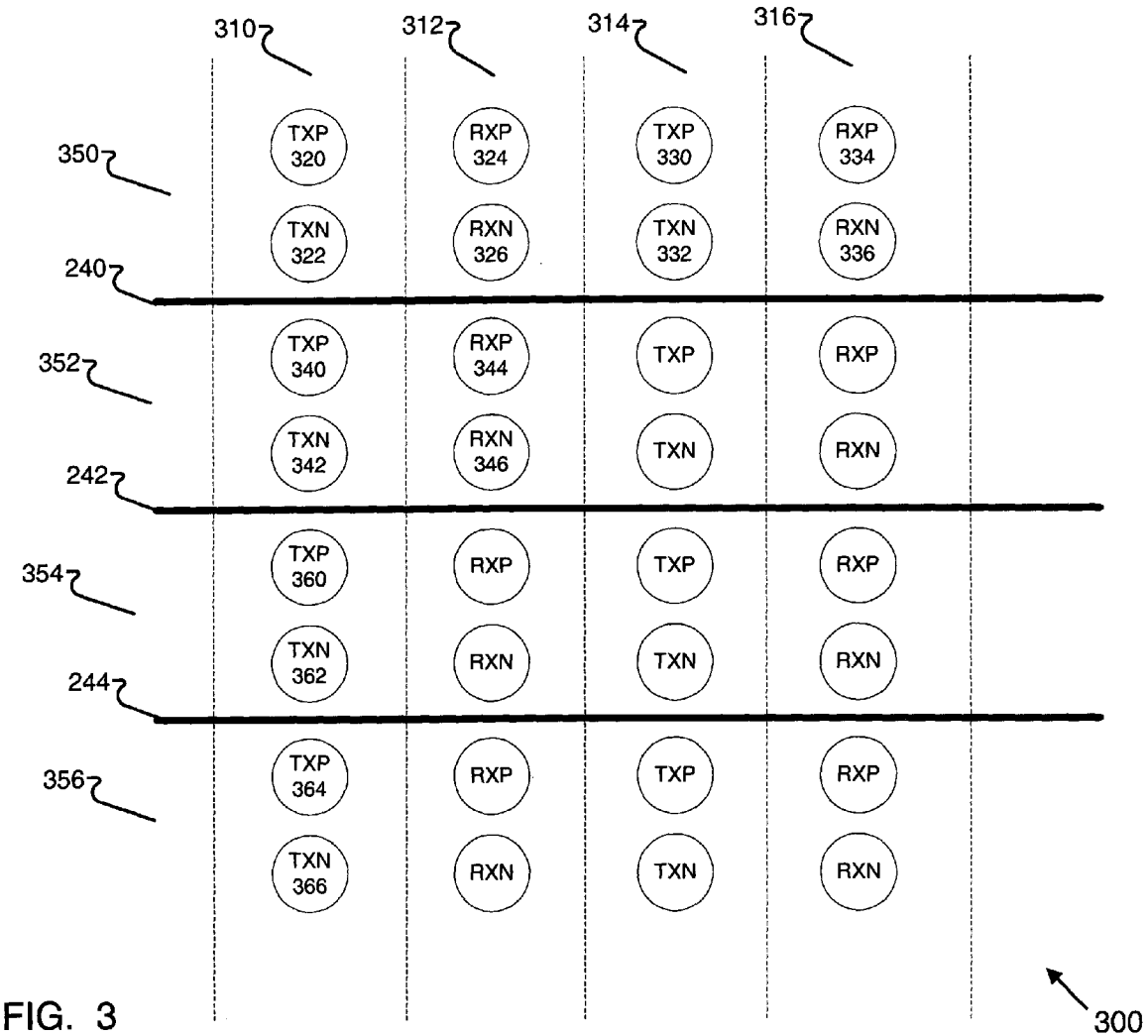
FIG. 3 (PRIOR ART)
FIG. 3 shows a prior art connector pin assignment for multiple serdes modules on a daughtercard.

From FIG. 3, one of the reasons there is crosstalk is that there is a mixture of receive connection positions and transmit connection positions in a single row. A preferred embodiment of the present invention has all transmit differential pairs (TXP/TXN) on a first row and the corresponding serdes receive differential pairs (RXP/RXN) on a second row (which may be adjacent to the first row), where the first row and second row are separated by a ground plane or structure, such as a ground shield of FIG. 1. In the preferred embodiment the ground shields are configured in the backplane connector 220 of FIG. 2. In an alternative embodiment the ground shields are configured in the daughtercard connector 210.

Figure 4:
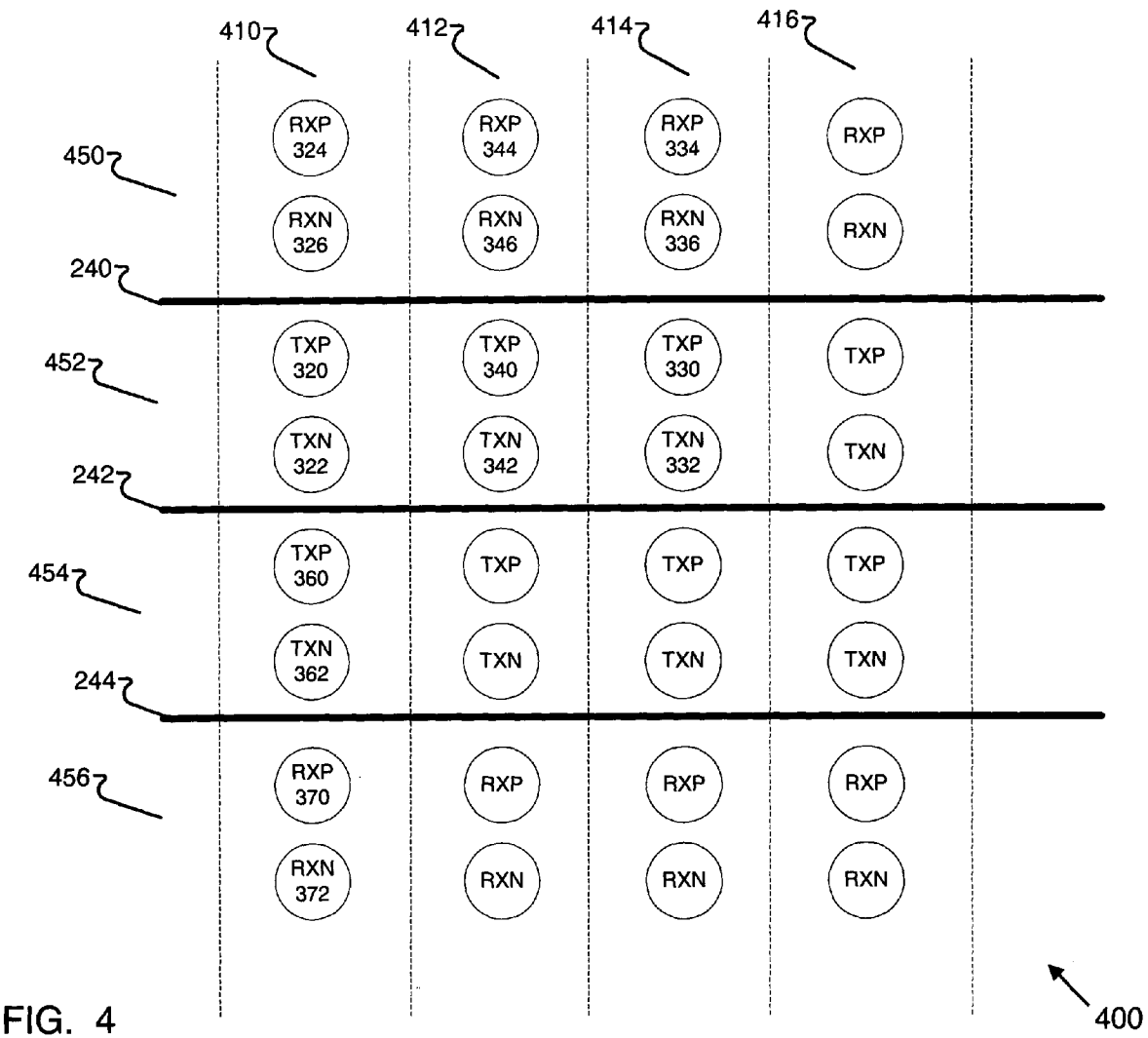
FIG. 4 is a partial connector pin assignment of a preferred embodiment of the present invention.

FIG. 4 is a partial connector pin assignment 400 of a preferred embodiment of the present invention. The complete connector assignment in the preferred embodiment includes four rows and 25 columns. FIG. 4 shows four columns 410, 412, 414, and 416 and four rows 450, 452, 454, and 456. The ground planes or structures, for example, ground shields 240, 242 and 244 (from FIG. 1) separate each row. FIG. 4 is similar to FIG. 3, except the connector pin positions have been reassigned so that each row has only differential receive pin pair connection positions (RXP/RXN) or differential transmit pin pair connection positions (TXP/TXN). The labels for the differential pin pair connection positions in FIG. 4 have been maintained from FIG. 3 to show how the pin pair connection positions have been moved.

For example TXP 320 and TXN 322 which was in row 350 and column 310 of FIG. 3 has been moved to row 452 and column 410 of FIG. 4. The associated serdes differential receive pair RXP 324 and RXN 326 located in row 350 and column 312 of FIG. 3 has been moved to row 450 and column 410 of FIG. 4. TPX 340 and TXN 342 in row 352 and column 310 has been moved to row 452 and column 412. RXP 344 and RXN 346 in row 352 and column 312 has been moved to row 450 and column 412. TPX 330 and TXN 332 in row 350 and column 314 have been moved to row 452 and column 414. RXP 334 and RXN 336 in row 350 and column 316 has been moved to row 450 and column 414. Hence FIG. 4 illustrates a row 450 of receive connection positions adjacent to a row 452 of transmit connection positions, where there is an interposing ground shield 240 between rows. The row 452 is adjacent to row 454 of transmit connection positions, where there is an interposing ground shield 242 between rows. The row 454 is adjacent to a row 456 of receive connection positions, where there is an interposing ground shield 244 between rows. Hence, crosstalk is significantly reduced because the transmit connection positions are shielded from the receiver connection positions.

FIG. 4 shows a row 450 of receive connection positions (abbreviated by "RX1" for discussion purposes). A row 452 of transmit connection positions (abbreviated by "TX1" for discussion purposes). A row 454 of transmit connection positions (abbreviated by "TX2" for discussion purposes). And a row 456 of receive connection positions (abbreviated by "RX2" for discussion purposes). In other words a partial connector pin assignment of [RX1, TX1, TX2, RX2]. Other permutations of partial connector pin assignments are [RX1, TX1, RX2, TX2][TX1, RX1, TX2, RX2] and [TX1, RX1, RX2, TX2].

With reference to FIGS. 2 and 4, the pins 230–237 are reassigned to new values as given in column 410. RXP 324 and RXN 326 are assigned to pins 230 and 231. TXP 320 and TXN 322 are assigned to pins 232 and 233. TXP 360 and TXN 362 are assigned to pins 234 and 235. RXP 370 and RXN 372 are assigned to pins 236 and 237.

Figure 5:
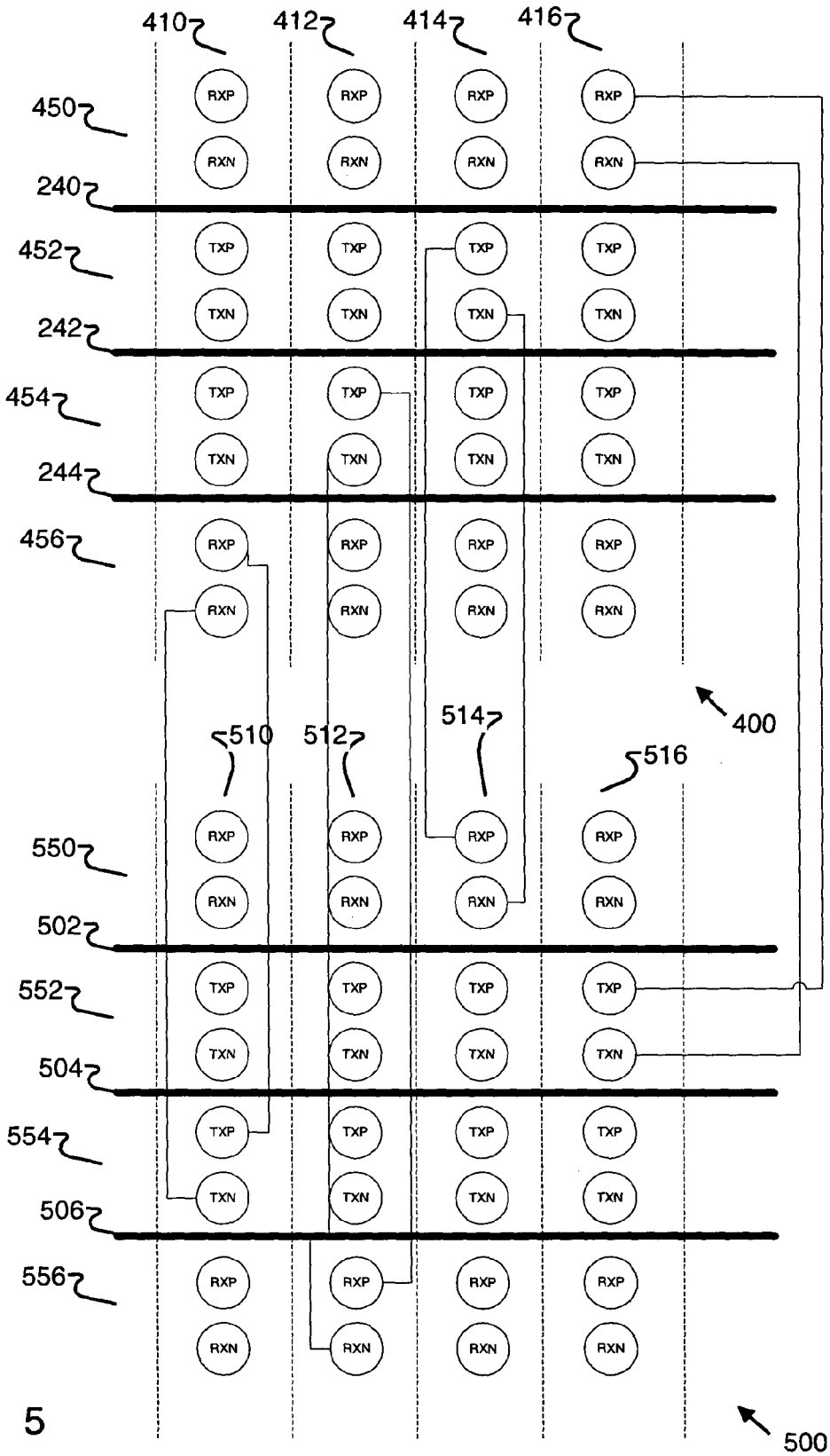
FIG. 5 is a diagram of some of the connections between two board connectors of an aspect of the present invention.

FIG. 5 is a diagram of some of the connections between two board connectors of an aspect of the present invention. The first board connector includes connector pin assignment 400 and the second board connector includes connector pin assignment 500. Connector pin assignment 400 was shown in FIG. 4. Connector pin assignment 500 is similar to connector pin assignment 400. Connector pin assignment 500 has four rows 550, 552, 554, and 556, where there are interposing ground shields 502, 504, and 506 between each row. Although, only four columns 510, 512, 514, and 516 are shown, there may be 25 columns. Each element in each column of connector pin assignment 400, e.g., 410, 412, 414, and 416, is connected to an associated element in the associated column, e.g., 510, 512, 514, and 516, respectively, in connector pin assignment 500. For clarity of illustration only one differential connector pin pair position is shown for a row on 400, e.g., RXP/RXN in column 416 of row 450 is connected to TXP/TXN in column 516 and row 552. However, the other differential connector pin pair positions in the row on 400, e.g. row 450, are similarly connected to the associated differential connector pin pair positions in the row in 500, e.g., row 552. TXP/TXN in row 452 and column 414 is connected to RXP/RXN in column 514 and row 550. TXP/TXN in row 454 and column 412 is connected to RXP/RXN in column 512 and row 556. RXP/RXN in row 456 and column 410 is connected to TXP/TXN in column 510 and row 554.

In the preferred embodiment each row in 400 is connected to its associated row in 500 on a different backplane layer. For example, RXP/RXN in row 450 and column 416 is connected to TXP/TXN in row 552 and column 516 via a first layer of the backplane. TXP/TXN in row 452 and column 414 is connected to RXP/RXN in column 514 and row 550 via a second layer of the backplane. TXP/TXN in row 454 and column 412 is connected to RXP/RXN in column 512 and row 556 via a third layer of the backplane. RXP/RXN in row 456 and column 410 is connected to TXP/TXN in column 510 and row 554 via a fourth layer of the backplane. Using different signal layers of the backplane, where there is an interposing ground layer between each signal layer in the backplane, reduces cross talk between signal wires (see U.S. Pat. No. 5,397,861, titled "Electrical Interconnection Board", by David H. Urquhart, issued Mar. 14, 1995, which is incorporated by reference, herein).

Although the invention has been described in connection with several embodiments, it is understood that this invention is not limited to the embodiments disclosed, but is capable of various modifications, which would be apparent to one of ordinary skill in the art. For example, although only one processor is shown on FPGA 100, it is understood that more than one processor may be present in other embodiments. Thus, the invention is limited only by the following claims.

What is claimed is:

1. A connector for connecting a circuit board to a backplane, comprising:

a first differential pair and a second differential pair of transmit connection positions in a first direction;

a receive connection position; and a ground shield positioned in the first direction between the first differential pair and second differential pair of transmit connection positions and the receive connection position, wherein the first differential pair and second differential pair of transmit connection positions do not have an interposing ground shield.

2. A connector for connecting a circuit board to a backplane, comprising:

first differential pair and second differential pair of receive connection positions in a first direction;

a differential pair of transmit connection positions; and a ground shield positioned in the first direction between the first and second differential pairs of receive connection positions and the differential pair of transmit connection positions, wherein the first and second differential pairs of receive connection positions do not have an interposing ground shield in a second direction perpendicular to the first direction.

3. A connector for connecting a circuit board to a backplane, comprising:

first, second, third, and fourth transmit connection positions in a direction;

first and second receive connection positions; and a ground shield positioned in the direction between the first, second, third, and fourth transmit connection positions and the first and second receive connection positions, wherein the first, second, third, and fourth transmit connection positions do not have an interposing ground shield.

4. The connector of claim 3 wherein the first and second receive connection positions do not have an interposing ground shield.

5. The connector of claim 3 wherein the first and second receive connection positions comprise differential receive pairs of connection positions.

6. The connector of claim 3 wherein the first and second transmit connection positions comprise single ended transmit connection positions.

7. The connector of claim 6 wherein the first and second receive connection positions comprise single ended receive connection positions.

8. A connector to a serial backplane comprising:

a first plurality of receive connection elements on the connector for at least two serializer/deserializer modules, wherein two receive connection elements of the first plurality do not have a first interposing ground plane;

a second plurality of transmit connection elements for the at least two serializer/deserializer modules, wherein the second plurality of transmit connection element is separated from the first plurality of the receive connection elements by a second interposing ground plane;

a third plurality of transmit connection elements for other serializer/deserializer modules, the third plurality of transmit connection elements positioned adjacent to the second plurality of transmit connection elements, wherein the third plurality of transmit connection elements is separated from the second plurality of transmit connection elements by a third interposing ground plane; and a fourth plurality of receive connection elements for the other serializer/deserializer modules, the fourth plurality of receive connection elements positioned adjacent to the third plurality of transmit connection elements, wherein the fourth plurality is separated from the third plurality by a fourth interposing ground plane.

9. The connector of claim 8 wherein the receive connection elements comprise first pins and the transmit connection elements comprise second pins.

10. The connector of claim 8 wherein the receive connection elements comprise corresponding female structures of the first pins and the transmit connection elements comprise corresponding female structures of the second pins.

11. A method for connecting a plurality of serializer/deserializer modules to a backplane, comprising:

selecting a plurality of transmit/receive pairs from the plurality of serializer/deserializer modules, wherein each transmit/receive pair has an associated transmit connection structure and an associated receive connection structure in a connector; and configuring a ground structure between the associated transmit connection structures and the associated receive connection structures, wherein there is no interposing ground structure between the associated receive connection structures.

12. The method of claim 11 wherein the plurality of serializer/deserializer modules are part of a programmable logic device.

13. The method of claim 11 wherein a serializer/deserializer module of the plurality of serializer/deserializer modules is part of a multi-giga bit transceiver (MGT) in a field programmable gate array (FPGA).

14. The method of claim 13 wherein the FPGA is part of a printed circuit board (PCB).

15. A connector for connecting a plurality of serializer/deserializer modules to a serial backplane, comprising:

means for locating a plurality of transmit/receive pairs from the plurality of serializer/deserializer modules, wherein each transmit/receive pair has means for connecting a transmit part of the transmit/receive pair to the backplane and means for connecting a receive part of the transmit/receive pair to the backplane; and means for configuring a first ground shield between means for connecting each transmit part of the plurality of transmit/receive pairs to the backplane and means for connecting each receive part of the plurality of transmit/receive pairs to the backplane, wherein there is no second ground shield between each transmit part of the plurality of transmit/receive pairs.

* * * * *